United States Patent [19]

Bixler et al.

[11] Patent Number: 4,742,952

[45] Date of Patent: May 10, 1988

[54] COMPOSITE CARTON

[75] Inventors: Kenneth D. Bixler, Lake Forest, Ill.; Daniel E. Keene, Gray, Me.; Fred R. Erxleben, Colts Neck, N.J.

[73] Assignee: Packaging Corporation of America, Evanston, Ill.

[21] Appl. No.: 893,858

[22] Filed: Aug. 6, 1986

[51] Int. Cl.[4] ..... B65D 43/18; B65D 85/32

[52] U.S. Cl. ..... 229/125.36; 206/45.31; 206/521.1; 220/339; 229/2.5 R

[58] Field of Search ..... 229/45 R, 45 EC, 44 EC, 229/2.5 EC, 2.5 R, 125.07, 125.08, 125.27, 125.36; 206/45.31, 45.34; 220/306, 337, 339, 4 B, 4 E

[56] References Cited

U.S. PATENT DOCUMENTS

| | | | |
|---|---|---|---|
| 2,746,081 | 5/1956 | Gershen | 220/339 |
| 3,258,187 | 6/1966 | Greatman | 229/2.5 EC |
| 3,424,363 | 1/1969 | Donovan | 229/2.5 EC |
| 3,568,914 | 3/1971 | Ahlmeyer | 206/45.34 |
| 3,570,747 | 3/1971 | McKenna | 229/2.5 EC |
| 3,669,606 | 6/1972 | Brown | 229/44 EC |
| 3,672,693 | 6/1972 | Weir | 229/2.5 EC |
| 3,985,289 | 10/1976 | Prince | 229/45 R |
| 4,428,497 | 1/1984 | Julius et al. | 220/339 |
| 4,471,881 | 9/1984 | Foster | 220/339 |

FOREIGN PATENT DOCUMENTS

| | | | |
|---|---|---|---|
| 1583862 | 2/1981 | United Kingdom | 220/339 |

*Primary Examiner*—Stephen Marcus
*Assistant Examiner*—Gary E. Elkins
*Attorney, Agent, or Firm*—Neuman, Williams, Anderson & Olson

[57] ABSTRACT

A composite carton is provided having a tray section and a cover section of dissimilar material connected thereto for relative movement about a predetermined foldline between open and closed positions. The tray section has a marginal portion provided with a plurality of longitudinally spaced apertures. The cover section is formed of a substantially transparent plastic and is provided with a marginal ledge having a first portion defining the predetermined foldline and a second portion offset from the foldline and provided with a plurality of stud-like protuberances. The protuberances are fixedly inserted in the corresponding apertures. The contents of the tray section are readily observable when the cover section is in a closed position.

13 Claims, 1 Drawing Sheet

COMPOSITE CARTON

BACKGROUND OF THE INVENTION

Because of the inordinate amount of egg breakage which occurs in the merchandizing of eggs in the supermarkets and self-service stores, it has become a serious problem for both the customer and retailer. The problem has been aggravated by the fact that it has become a customary practice or habit of the potential customer to open the loaded carton to inspect the contents before making the purchase. Where egg damage is found, the customer returns the carton to the display area, normally without closing the carton, and then proceeds to pick up another loaded carton for inspection. The procedure is repeated until the customer finds a carton with undamaged eggs. Such a procedure is an awkward, time-consuming and frustrating manipulation, oftentimes discouraging the customer from making the purchase. As far as the retailer is concerned, the aforedescribed practice of the customer creates an unsightly, disarranged display of the loaded cartons, and where the customer returns the unwanted carton to the display area without reclosing the carton, the next customer, when handling the returned carton, might cause the eggs to accidently fall out of the carton unless extreme care is exercised in handling same. The foregoing problems adversely affect the retailer's reputation for convenience and high quality merchandise, causes an inordinate amount of time and expense in returning the damaged eggs to the wholesaler for repacking and replacement, and increases overall the costs of doing business for both the wholesaler and retailer.

SUMMARY OF THE INVENTION

Thus, it is an object of the invention to provide a composite carton which is of simple and inexpensive construction, provides good protection for the accommodated product or products, and enables the customer to readily observe the contents of the carton while the cover section remains in a closed position.

It is a further object to provide a composite carton where the cover section thereof may be readily closed by conventional, high-speed, automatic closing machines normally utilized in commercial, egg packing plants.

It is a still further object to provide a composite carton which has an aesthetic appearance, and may be readily opened or closed by a simple manual manipulation.

It is a still further object to provide a composite carton having the cover and tray sections thereof of dissimilar materials and yet the sections are permanently hinged together.

Further and additional objects will appear from the description, accompanying drawings and appended claims.

In accordance with one embodiment of the invention, an improved composite carton is provided having a tray section and a cover section which is connected to a side of the tray section for movement about a predetermined foldline between open and closed positions. The cover and tray sections are of dissimilar materials with the cover section being formed of a substantially transparent plastic allowing the accommodated article, or articles, to be readily observed while the cover section remains in a close position. The tray section is provided with a marginal portion having a plurality of pocket means arranged in longitudinally spaced relation. The cover section is provided with a marginal ledge having a first portion defining the predetermined foldline, and a second portion offset from the foldline and having a plurality of longitudinally spaced, protruding means fixedly disposed within the pocket means.

DESCRIPTION

For a more complete understanding of the invention, reference is made to the drawing wherein:

FIG. 1 is a perspective view of the improved composite carton with the cover section thereof in an open position to permit loading and unloading of the tray section.

Figure 4:
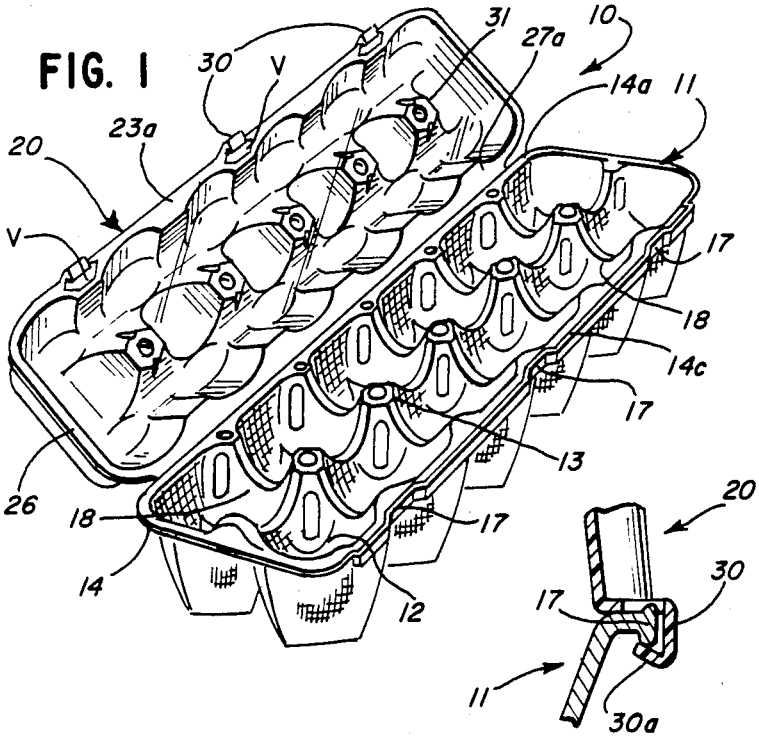
FIG. 4 is an enlarged fragmentary sectional view taken along line 4—4 of FIG. 2.

Referring now to the drawing and more particularly to FIG. 1, an improved composite carton 10 is shown which in the illustrated embodiment is particularly suitable for accommodating a dozen eggs. While the invention will be described hereinafter in relation to an egg carton it is not intended to be limited thereto.

Carton 10 includes a tray section 11 which is preferably formed of molded pulp or molded foam plastic material. The tray section is provided with a plurality of egg-accommodating cells 12 arranged in two parallel rows of six cells each. The shape and size of the cells may vary from that shown and form no part of the invention herein described. The rows of cells are separated by a row of upstanding posts 13 which, as illustrated, projects above a plane A-A defined by a laterally extending flange 14 surrounding the open top of the tray section, see FIG. 3. A marginal portion **14*a* of the flange, defining the elongated rear side of the tray section, is provided with a plurality of longitudinally spaced apertures 15. The apertures 15 are aligned in a row which is substantially parallel to the row alignment of the cells 12. Each aperture is aligned with a transverse plane which extends between adjacent cells in a row. The number of apertures formed in marginal portion 14*a*** may vary from that shown without departing from the scope of the invention.

Figure 8:
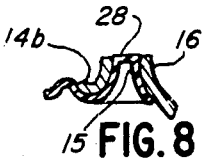
FIG. 8 is an enlarged fragmentary sectional view taken along line 8—8 of FIG. 7.

As seen in FIG. 8, each aperture 15 is preferably located in the upper surface of a hollow pedestal-like projection 16 formed in the marginal portion and recessed a short distance from the outer edge **14*b* of the flange. The pedestal-like projection 16** provides added stiffness to the marginal portion in the vicinity of the aperture.

A second marginal portion **14*c* of the flange 14 defines the elongated front side of the tray section 11. The marginal portion 14*c* is provided with a plurality of indentations 17 which constitute a complemental locking means to be described more fully hereinafter. The indentations 17 are aligned with hollow ribs 18 which separate adjacent cells in a row and interconnect the front and rear sides of the tray section to the upright posts 13**.

Figure 6:
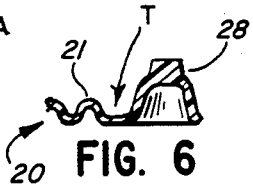
FIG. 6 is an enlarged fragmentary sectional view taken along line 6—6 of FIG. 5.
Figure 5:
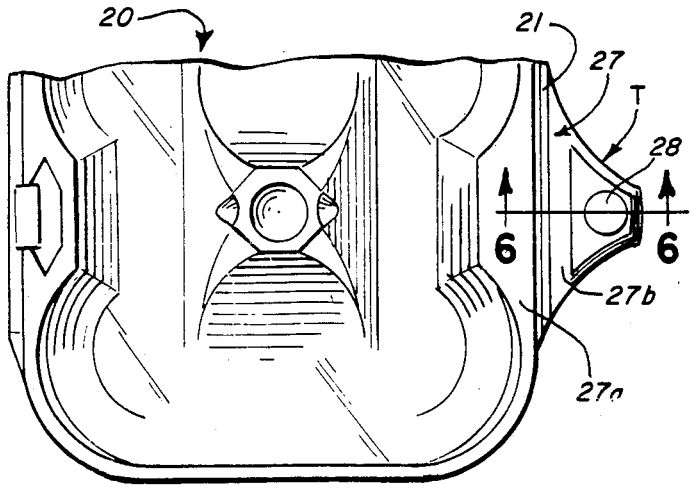
FIG. 5 is an enlarged fragmentary bottom plan view of the cover section per se.
Figure 7:
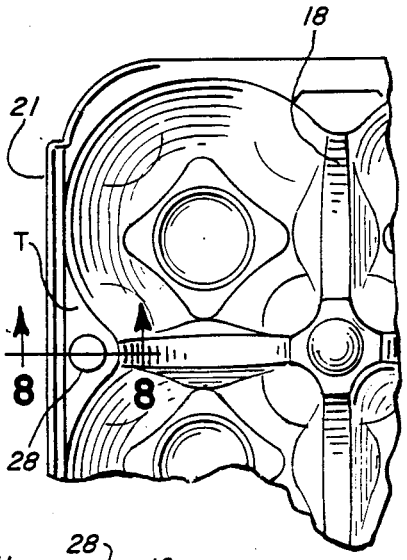
FIG. 7 is an enlarged fragmentary bottom view of the carton of FIG. 2.

Connected to the marginal portion 14*a* of the tray section is a cover section 20. The cover section is adapted to be moved about a predetermined foldline 21 between open and closed positions (FIGS. 1 and 3, respectively) relative to the open top of tray section 11. The cover section is separately fabricated and is preferably formed of a substantially transparent heatformable plastic. The cover section includes a central portion 22, depending front and rear walls 23,24 and depending end walls 25. The depending walls terminate in a peripheral flange 26 which delimits an open bottom. When the cover section is closed, the flange 26 rests upon the flange 14 of the tray section 11. The portion of the cover section flange adjacent the rear wall 24 forms a ledge 27, see FIG. 5. The ledge includes a first portion 27*a* having a segment thereof which defines the foldline 21, and a second portion 27*b* which, as shown in FIG. 5, is offset outwardly from the foldline 21. The second portion 27*b* includes a plurality of longitudinally spaced tabs T. The number of tabs correspond to the number of apertures 15 formed in the marginal portion 14*a* of the tray section 11. As seen in FIGS. 5 and 6 each tab T is provided with a stud-like protuberance 28. The protuberances are sized to snugly fit within the corresponding apertures 15.

In one method of attaching the cover section 20 to the tray section 11, the tabs T are supported so that the protuberances 28 project upwardly and the marginal portion 14*a* of the tray section 11 is positioned over the ledge 27 and then pushed down onto the ledge whereby the protuberances thereof will be inserted into the corresponding apertures 15. In the illustrated embodiment, the tops of the protuberances 28 extend slightly above the apertures whereupon the protruding tops are compressed by a heated roller or the like, not shown, causing the tops to be enlarged and thus, become impassable relative to the apertures. By reason of the tops of the protuberances 28 being enlarged the tabs T are in effect riveted to the rear marginal portion 14*a* of the tray section. If desired, the protuberances 28 and the remainder of the tabs can be secured to the marginal portion 14*a* by a suitable adhesive material. As seen in FIG. 8, the configurations of the underside of the apertured marginal portion 14*a* and of the upper side of the tabs T are such that each tab T nests under the apertured marginal portion 14*a* of the tray section 11. In lieu of the apertures, closed sockets, not shown, may be formed in marginal portion 14*a* and the protuberances 28 compressed therein and retained in place by suitable adhesive.

The front side of the cover section 20 is provided with a plurality of depending resilient locking fingers 30. The lower edges 30*a* of the fingers are folded back a small amount so as to form a hook-like member, see FIG. 4. When the cover section assumes a closed position, the lower edges 30*a* of the fingers 30 will automatically interlock with the undersides of the indentations 17. Because the plastic utilized in forming cover section 20 is relatively flexible, the fingers 30 may be manually pulled outwardly a sufficient amount so as to clear the corresponding indentations thereby allowing the cover section to manually hinged to an open position. When the cover section is moved to a closed position, the lower edges 30*a* of the fingers 30 will engage the upper corners of the indentation 17 causing the finger edges to be cammed outwardly and slide past the indentations. When the edges have cleared the bottom edges of the indentations, the edges will snap into interlocking relation therewith.

To provide the desired flexibility to the fingers 30, a segment of the front flange 23 of the cover section, immediately behind each finger 30, may be removed leaving a void V, see FIG. 1. Other types of locks well known in the art may be utilized to retain the cover section 20 in a closed position.

Figure 3:
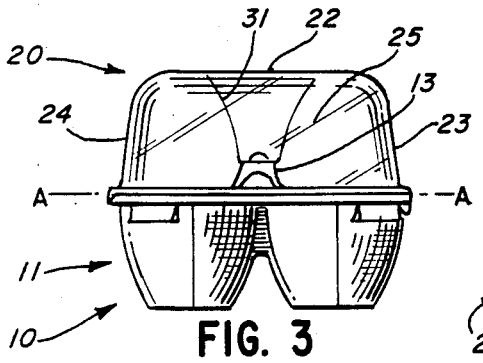
FIG. 3 is an end view of the carton of FIG. 2.

In the illustrated embodiment, the center portion 22 of the cover section 20 is provided with a plurality of depending posts 31 which abut the tops of the tray section posts 13, see FIG. 3, thereby providing reinforcement for the cover section 20 when the latter assumes a closed position.

Figure 2:
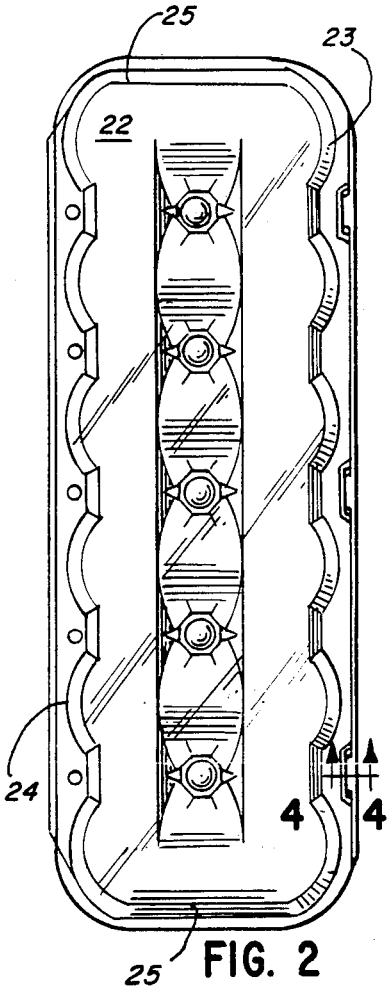
FIG. 2 is an enlarged top plan view of the carton with the cover section thereof in a closed position.

It will be noted in FIG. 2 that, when the cover section is in the closed position, a second segment of the first portion 27*a* of the ledge, disposed to one side of the foldline 21, will substantially overlie the marginal portion 14*a* of the tray section flange 14 and the enlarged tops of the stud-like protuberances 28. Thus, the enlarged tops of the protuberances 28 are shielded by the second segment of portion 27*a* of the ledge 27.

As aforementioned, the size and shape of the cover and tray sections may vary from that shown without departing from the scope of the invention. Furthermore the number and shape of the tabs T may also be varied. While the invention has been described in relation to an egg carton it is not intended to be limited thereto but may be utilized in any type of composite carton wherein it is desirable to be able to observe the contents thereof without opening the carton. Furthermore, the improved composite carton has the cover section thereof hingedly attached in a permanent manner to the tray section thereof, notwithstanding that the sections are of dissimilar materials and are separately fabricated. By reason of the permanent hinged connection between the cover and tray sections, the composite carton may be readily closed by conventional high speed automatic closing equipment normally found in commercial packing plants.

We claim:

1. A composite carton comprising a tray section and a cover section hingedly connected to one side of said tray section and movable relative thereto about a predetermined foldline between open and close positions, said tray and cover sections having complemental open sides disposed in proximate superposed relation when said sections are in a closed position, said sections being formed of dissimilar materials, one section being provided with a laterally projecting marginal portion delimiting the open side thereof, said marginal portion having a plurality of longitudinally spaced means formed therein and offset in one direction from the foldline, the other section being provided with a laterally projecting marginal ledge delimiting the open side thereof, said other section having a first portion extending from said marginal ledge and defining the predetermined foldline, and a second portion extending from said first portion and coacting with said marginal ledge to sandwich therebetween said one section marginal portion, said second portion being provided with a plurality of longitudinally spaced protruding means fixedly engaging said marginal portion means.

2. The composite carton of claim 1 wherein the marginal portion means includes a plurality of apertures, and the protruding means includes a plurality of stud-like protuberances fixedly inserted in corresponding apertures.

3. The composite carton of claim 2 wherein the second portion of the marginal ledge includes a plurality of longitudinally spaced tabs, each tab being provided with a stud-like protuberance.

4. The composite carton of claim 1 wherein the material of which one of the sections is formed is a substantially transparent heat-formable plastic.

5. The composite carton of claim 4 wherein the other section is formed of moldable material.

6. The composite carton of claim 5 wherein the tray section is of moldable material and is provided with at least one cell for accommodating a product; the accommodated product being observable when the cover section is in a closed position.

7. The composite carton of claim 1 wherein the marginal ledge and the second portion are disposed on opposite sides of the predetermined foldline when the sections are in a fully open position.

8. The composite carton of claim 1 wherein the tray section is of molded pulp material and is provided with at least one row of cells for accommodating fragile articles, and the cover section is formed of a substantially transparent heat formable plastic whereby the cell-accommodated fragile articles are observable when the cover section is in a closed position.

9. The composite carton of claim 8 wherein the tray section is provided with at least one upstanding post, said post supportingly engaging said cover section when the latter assumes a closed position.

10. The composite carton of claim 9 wherein the cover section is provided with at least one depending post which abuttingly engages a corresponding upstanding post formed in the tray section when the cover section assumes a closed position.

11. A composite carton for accommodating a plurality of eggs, said carton comprising a molded tray section provided with a plurality of egg-accommodating cells arranged in adjoining parallel rows; and a cover section formed of a substantially transparent heat-formable plastic, said cover section being permanently connected to one side of the tray section and movable relative thereto about a predetermined foldline between open and closed positions, any eggs accommodated in said cells being observable through the cover section when the latter is in a closed position, the predetermined foldline being substantially parallel to a row of egg-accommodating cells; the tray section being provided with a marginal portion delimiting an open top of said tray section, said marginal portion having formed therein a row of longitudinally spaced means offset inwardly from and substantially parallel to the predetermined foldline, the cover section being provided with a marginal ledge delimiting an open bottom therefor, a first portion extending outwardly from the marginal ledge and defining the predetermined foldline, and a second portion extending from said first portion being provided with a row of stud-like protuberances fixedly engaging the marginal portion means of the tray section whereby the marginal portion is substantially sandwiched between the marginal ledge and the second portion of the cover section when the latter is in the closed position.

12. The composite carton of claim 11 wherein the longitudinally spaced means of the tray section marginal portion includes a plurality of apertures into which the stud-like protuberances of the tray section are fixedly inserted.

13. The composite carton of claim 11 wherein corresponding segments of the tray section marginal portion and the cover section marginal ledge are provided with complemental locking means for releasably retaining the cover section in a closed position.

* * * * *